US010605018B2

(12) United States Patent
Schmidt et al.

(10) Patent No.: US 10,605,018 B2
(45) Date of Patent: Mar. 31, 2020

(54) WELLBORE ANCHORING ASSEMBLY

(71) Applicant: HALLIBURTON ENERGY SERVICES, INC., Houston, TX (US)

(72) Inventors: Daniel Lee Schmidt, Duncan, OK (US); Brian Keith Ogle, Duncan, OK (US); Matt Brian Roseman, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 163 days.

(21) Appl. No.: 15/578,762

(22) PCT Filed: Jul. 9, 2015

(86) PCT No.: PCT/US2015/039646

§ 371 (c)(1),
(2) Date: Dec. 1, 2017

(87) PCT Pub. No.: WO2017/007476

PCT Pub. Date: Jan. 12, 2017

(65) Prior Publication Data

US 2018/0298708 A1 Oct. 18, 2018

(51) Int. Cl.
*E21B 23/01* (2006.01)
*E21B 33/129* (2006.01)

(52) U.S. Cl.
CPC ..... *E21B 23/01* (2013.01); *E21B 33/1291* (2013.01); *E21B 33/1293* (2013.01)

(58) Field of Classification Search
CPC ... E21B 23/01; E21B 33/1291; E21B 33/1293
See application file for complete search history.

(56) References Cited

U.S. PATENT DOCUMENTS

| | | | |
|---|---|---|---|
| 4,934,459 | A | 6/1990 | Baugh et al. |
| 5,014,782 | A | 5/1991 | Daspit |
| 5,101,897 | A | 4/1992 | Leismer et al. |
| 5,379,835 | A | 1/1995 | Streich |

(Continued)

FOREIGN PATENT DOCUMENTS

CA 2628164 A1 5/2007

OTHER PUBLICATIONS

Halliburton Completion Tools, Fas Drill Frac Plug, Service Tools, H06159, Jul. 2014.

(Continued)

*Primary Examiner* — Kristyn A Hall
(74) *Attorney, Agent, or Firm* — Polsineli PC

(57) ABSTRACT

A wellbore anchoring assembly including a downhole device, a collar, and one or more deformable locking arms attached to the collar wherein the locking arms extend in a direction substantially along the longitudinal axis of the collar. The downhole device having a first component, the surface of the first component having a first protrusion. Each of the locking arms being deformable away from the longitudinal axis, one or more gripping protrusions extend out from an outer surface of the locking arms, and at least one second protrusion extends from an inner surface of the locking arms. The inner surface is engageable with the surface of the first component to deform the locking arms away from the longitudinal axis. Upon engagement, the at least one first protrusion engages the at least one second protrusion to secure the collar to the downhole device.

18 Claims, 8 Drawing Sheets

(56) References Cited

U.S. PATENT DOCUMENTS

| | | | |
|---|---|---|---|
| 6,167,963 | B1 | 1/2001 | McMahan et al. |
| 2007/0102165 | A1 | 5/2007 | Slup et al. |
| 2010/0263857 | A1 | 10/2010 | Frazier |
| 2011/0005779 | A1 | 1/2011 | Lembcke |
| 2012/0097384 | A1 | 4/2012 | Valencia et al. |

OTHER PUBLICATIONS

International Search Report and Written Opinion; PCT Application No. PCT/US2015/039646; dated Feb. 25, 2016.

WELLBORE ANCHORING ASSEMBLY

CROSS-REFERENCE TO RELATED APPLICATIONS

This application is a national stage entry of PCT/US2015/039646 filed Jul. 9, 2015, said application is expressly incorporated herein in its entirety.

FIELD

The present disclosure relates generally to wellbore anchoring operations. In particular, the subject matter herein generally relates to an anchoring assembly that can be used to anchor downhole tools within a wellbore.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

Downhole tools, such as frac plugs, are commonly run into the wellbore on a conveyance such as a wireline, work string or production tubing. Such tools typically have either an internal or external setting tool, which is used to set the downhole tool within the wellbore and hold the tool in place. The downhole tools are typically held into place by a plurality of slips, which extend outwards when actuated to engage and grip a casing within a wellbore, and a sealing assembly, which can be made of rubber and extends outwards to seal off the flow of liquid around the downhole tool.

BRIEF DESCRIPTION OF THE DRAWINGS

Implementations of the present technology will now be described, by way of example only, with reference to the attached figures, wherein.

DETAILED DESCRIPTION

Figure 1:
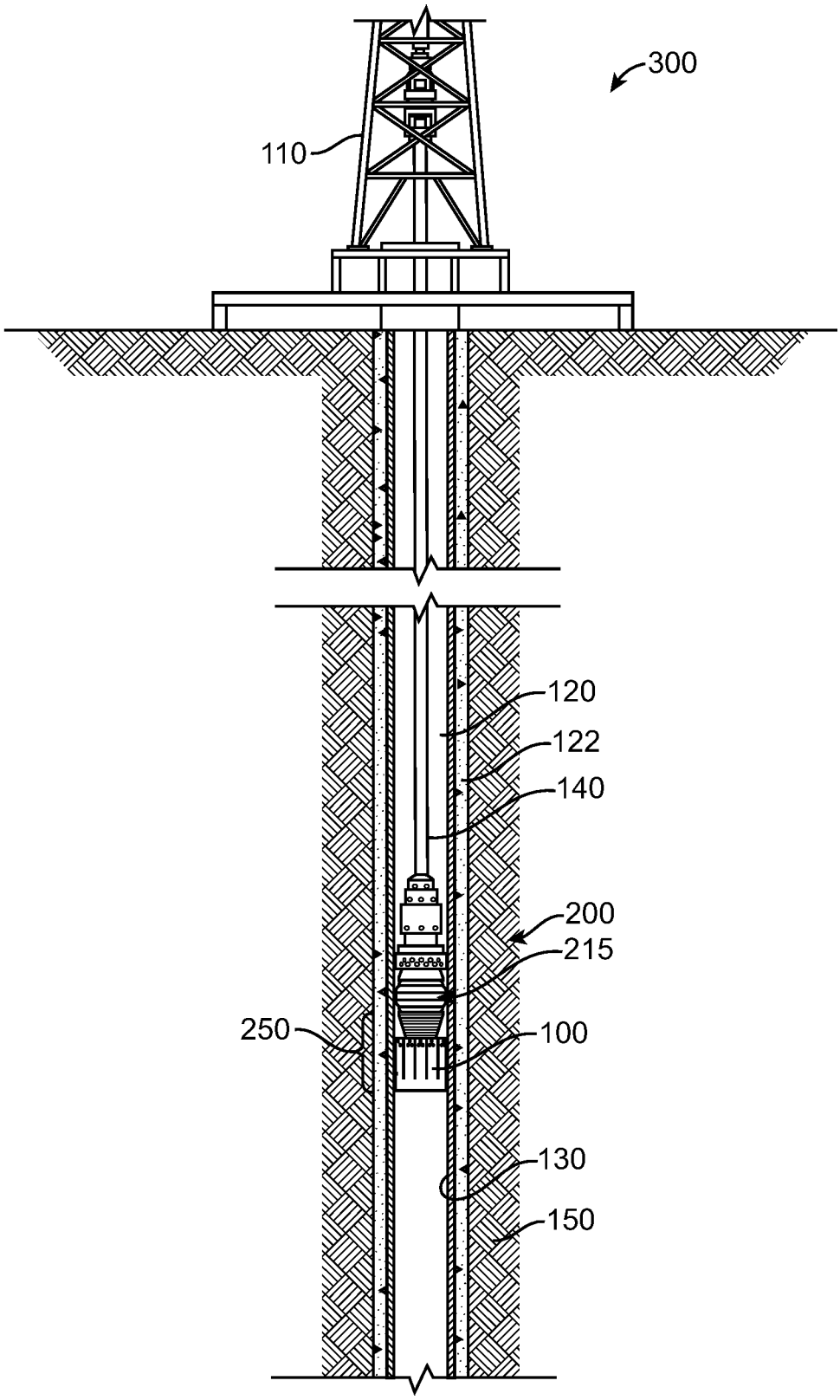
FIG. 1 is a diagram illustrating an exemplary environment for an anchoring assembly according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Disclosed herein is an anchoring apparatus for setting a downhole tool within a wellbore. The anchoring apparatus as disclosed herein includes a cylindrical collar and a plurality of deformable locking arms engageable with an outer surface of a downhole tool. The downhole tool can deform the locking arms such that protrusions on the outside surface of the locking arms grip onto the casing of the wellbore such that the anchoring apparatus and downhole tool are fixed into place. Due to the deformability of the anchoring apparatus, the setting process of a downhole tool may be simplified, and furthermore, the anchoring apparatus may also permit the size of the downhole tool to be greatly decreased as well as allow for the omission of various internal setting mechanisms.

The anchoring assembly disclosed herein may be used in combination with any of a variety of downhole tools, including, but not limited to, frac plugs, packers, and bridge plugs, or other tools with sealing assemblies.

A frac plug may include an elongated tubular body member with an axial flowbore extending therethrough, and a ball, which can act as a one-way check valve. The ball, when seated on an upper surface of the flowbore, acts to seal off the flowbore and prevent flow downwardly therethrough, but permits flow upwardly through the flowbore. Frac plugs may include a cage formed at the upper end of the tubular body member to retain the ball.

A packer generally includes a mandrel having an upper end, a lower end, and an inner surface defining a longitudinal central flow passage. More specifically, a packer element assembly can extend around the tubular body member; and include one or more slips mounted around the body member, above and below the packer assembly. The slips can be guided by mechanical slip bodies.

A bridge plug generally includes a plug mandrel, one or more slips, and a rubber sealing element and is typically used for zonal isolation within a wellbore. More specifically, a bridge plug is a mechanical device installed within a wellbore and used for blocking the flow of fluid from one part of the wellbore to another.

A sealing assembly may also be included in a downhole tool such as a packer or a frac plug. A sealing assembly allows the downhole tool to expand to a larger size, sealing off portions of the wellbore. For example, the sealing assembly can be an expandable seal element, which can be positioned around the packer mandrel; such sealing assembly can include any number of expandable seal elements. Such sealing assemblies can be expanded by movement of the downhole tool upward, forcing a portion of the downhole tool onto an internal wedge and expanding the sealing elements outwardly toward the wellbore casing. Alternately, a sealing element can be disposed about the mandrel of the downhole tool for sealingly engaging the wellbore.

The wellbore anchoring assembly can be employed in an exemplary wellbore system 300 shown, for example, in FIG. 1. A system 300 for anchoring a downhole tool in a wellbore includes a drilling rig 110 extending over and around a wellbore 120. The wellbore 120 is within an earth formation 150 and has a casing 130 lining the wellbore 120, the casing 130 is held into place by cement 122. An anchoring assembly 250 includes an anchoring apparatus 100 and downhole tool 200; the downhole tool 200 can include a sealing assembly 215. The anchoring assembly 250 can be moved down the wellbore 120 via a conveyance 140 to a desired location. A conveyance can be, for example, tubing-conveyed, wireline, slickline, work string, or any other suitable means for conveying downhole tools into a wellbore. Once the anchoring apparatus 100 and the downhole tool 200 reach the desired location a setting device may be actuated to anchor the downhole tool into place. It should be noted that while FIG. 1 generally depicts a land-based operation, those skilled in the art would readily recognize that the principles described herein are equally applicable to operations that employ floating or sea-based platforms and rigs, without departing from the scope of the disclosure.

Figure 2:
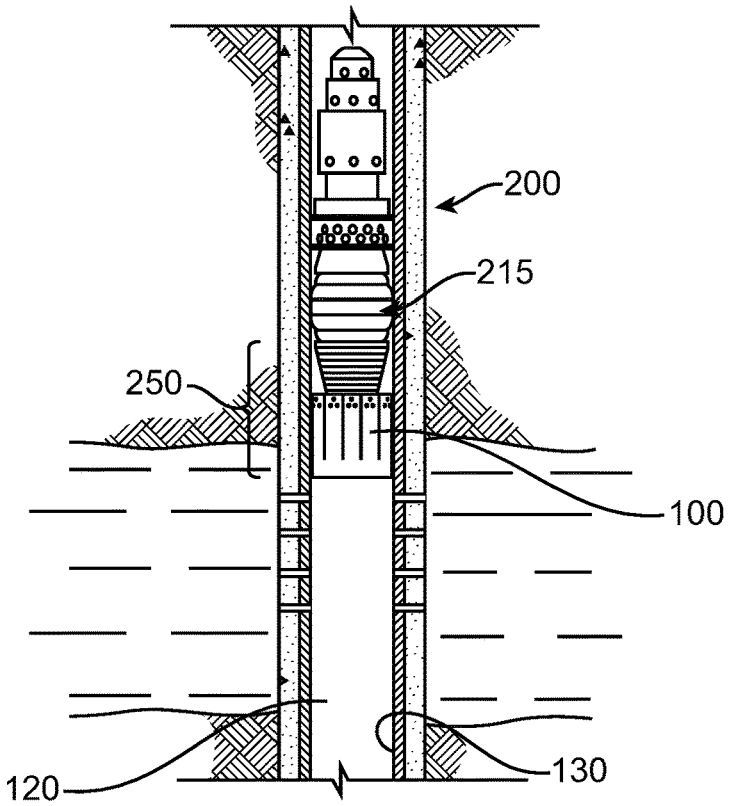
FIG. 2 is a diagram illustrating an exemplary environment for an anchoring assembly in a resting configuration.
Figure 3:
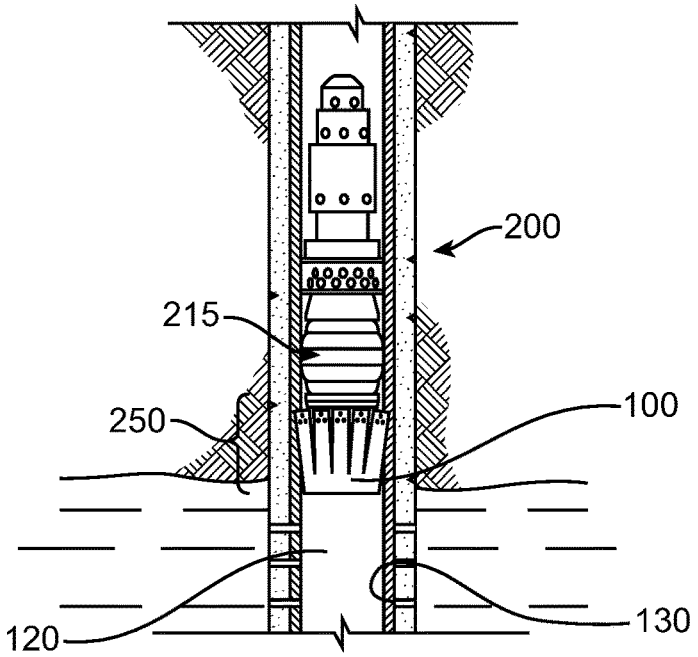
FIG. 3 is a diagram illustrating an exemplary environment for an anchoring assembly in an engaged configuration.

FIG. 2 depicts an exemplary anchoring assembly 250 in a resting configuration disposed within a wellbore 120. In the resting configuration, the anchoring apparatus 100 is coupled to the downhole end of the downhole tool 200. The anchoring assembly 250 is configured such that the anchoring assembly 250 can be moved uphole or downhole without catching on the casing of the wellbore. Illustrated in FIG. 3 is the anchoring assembly 250 of FIG. 2 in an engaged configuration, showing the anchoring apparatus 100 fully engaged with the downhole tool 200 and the anchoring assembly 250 is secured within the wellbore 120. In the engaged configuration, protrusions on the anchoring apparatus 100 grip onto the casing 130 lining the wellbore 120, such that the anchoring apparatus 100 and the downhole tool 200 are fixed into place. As the anchoring assembly 250 transitions to the engaged configuration, the sealing assembly 215 can also expand to seal off the wellbore 120 and prevent flow therethrough.

Figure 4:
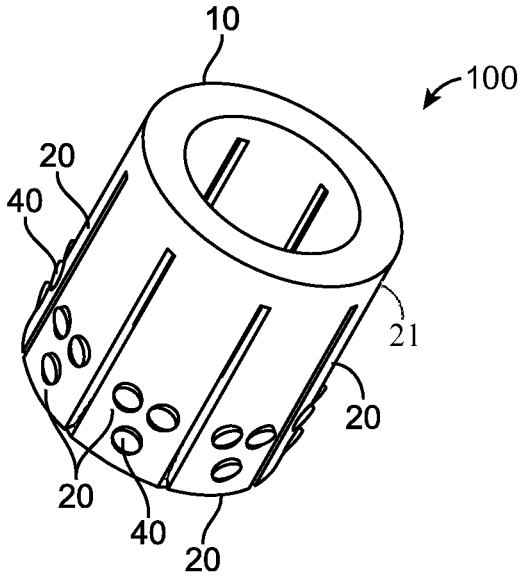
FIG. 4 is a diagram of a first exemplary embodiment of a anchoring apparatus according to the present disclosure.
Figure 5:
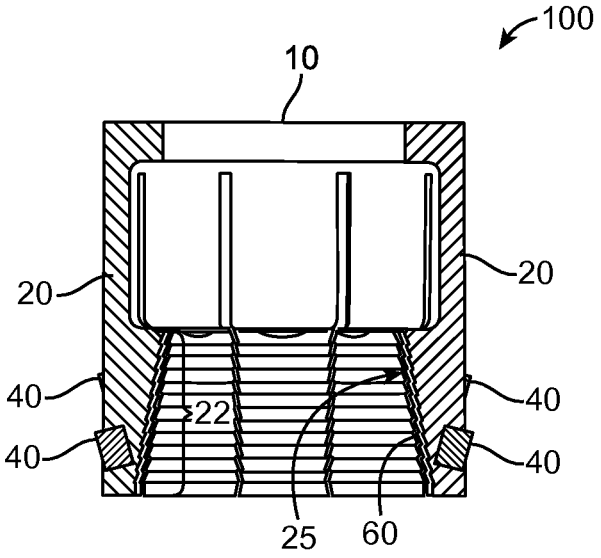
FIG. 5 is a cross-sectional diagram of the exemplary anchoring apparatus of FIG. 4.

Illustrated in FIG. 4 is one example of an anchoring apparatus 100 that can be used in the exemplary wellbore system 300 of FIG. 1. The anchoring apparatus 100 can include a collar 10 having main body 21 and one or more locking arms 20 deformable in a radial direction away from the longitudinal axis of the anchoring apparatus 100. It should be noted, while the figures generally depict a substantially cylindrical collar, those skilled in the art would readily recognize that the principles described herein are equally applicable to collars that are substantially octagonal, hexagonal, ovular, ovoid, or any other suitable shape. The deformable locking arm(s) 20 are configured such that when a force is applied to the inner surface of the locking arm(s) 20, the locking arm(s) 20 will become radially displaced with respect to the central axis of the anchoring apparatus 100. One or more gripping protrusions 40 can be located on the outer surface of the deformable locking arm(s) 20. The gripping protrusion(s) 40 can be located along the length of the outer surface of the locking arms 20. A cross-sectional view of the anchoring apparatus 100 is shown in FIG. 5. The locking arm(s) 20 can have an inner surface 25, at least a portion of which may be sloped towards the central axis of the anchoring apparatus 100 forming a sloped portion 22; the sloped portion 22 can have at least one protrusion 60. The at least one protrusion 60 can be a ratcheted protrusion, or series of ratcheted protrusions, for example, a series of ratcheted teeth.

Figure 6:
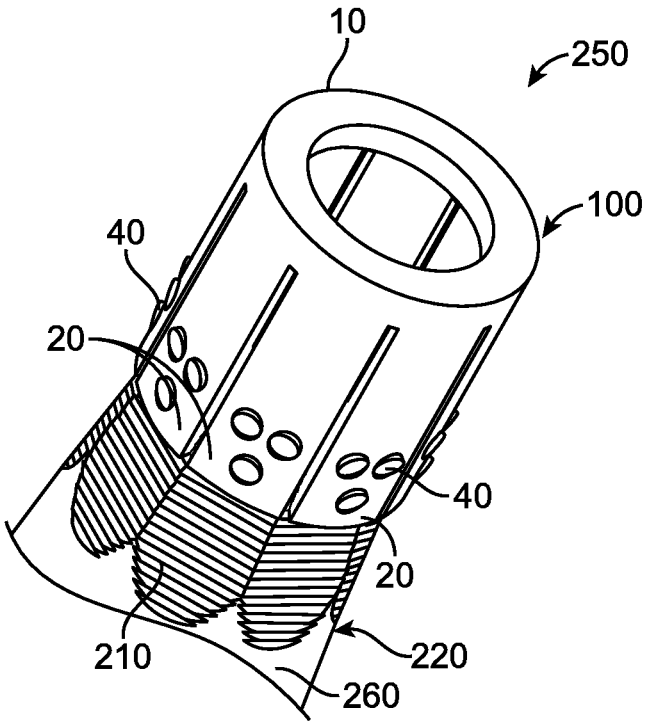
FIG. 6 is a diagram of the first exemplary anchoring assembly in a resting configuration according to the disclosure herein.
Figure 7:
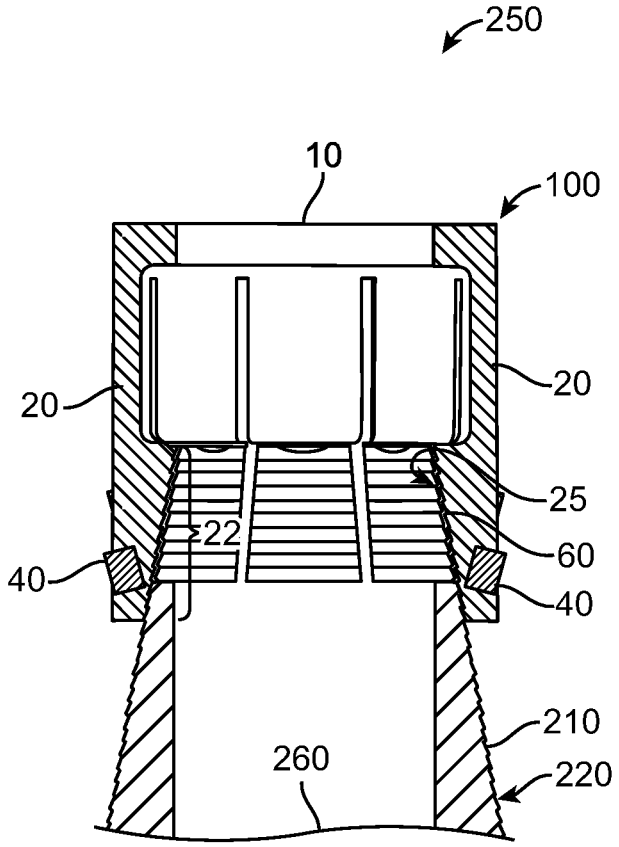
FIG. 7 is a cross-sectional diagram of the exemplary anchoring assembly of FIG. 6.

FIG. 6 illustrates an anchoring assembly 250 including the anchoring apparatus 100 (as shown in FIG. 4) coupled to the first component 260 of a downhole tool 200 in the resting configuration. In this configuration, the protrusion(s) 60 of the inner surface 25 of the locking arm(s) 20 of the anchoring apparatus 100 engage with a protrusion 210, or series of protrusions 210, on the outer surface 220 of the first component 260. The engagement of the protrusions is such that the anchoring apparatus 100 is held, at least partially, onto the downhole tool 200, allowing the anchoring apparatus 100 and the downhole tool 200 to be moved down the wellbore together. A cross-sectional view of the resting configuration of the anchoring assembly 250 is shown in FIG. 7, showing the engagement of the protrusion(s) 60 of the anchoring apparatus 100 and the protrusion(s) 210 of the first component 260 of the downhole tool 200. While the figures generally depict a first component with a sloped outer surface, those skilled in the art would readily recognize that the principles herein could be equally applicable to a downhole device with a first component without a sloped outer surface.

Figure 8:
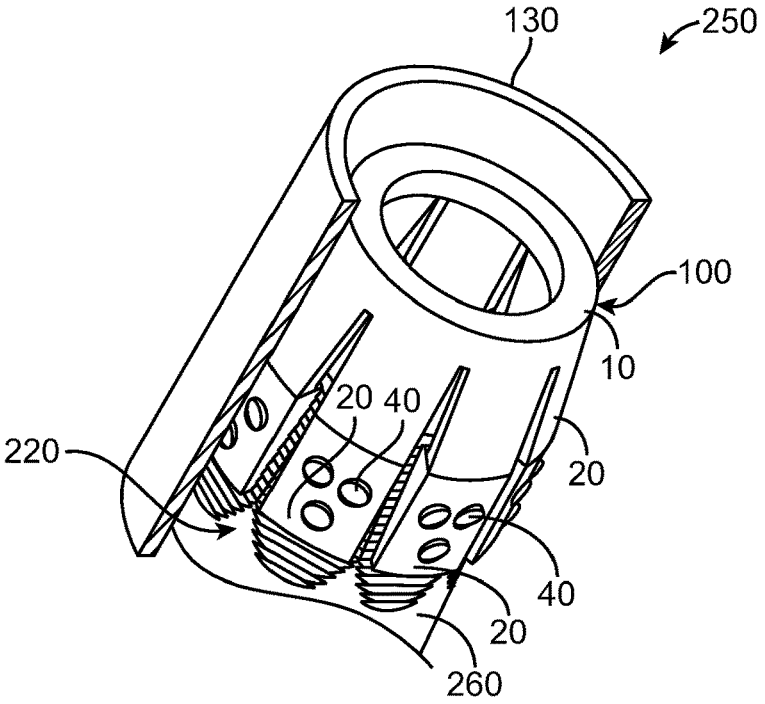
FIG. 8 is a diagram of the first exemplary anchoring assembly in an engaged configuration according to the disclosure herein.
Figure 9:
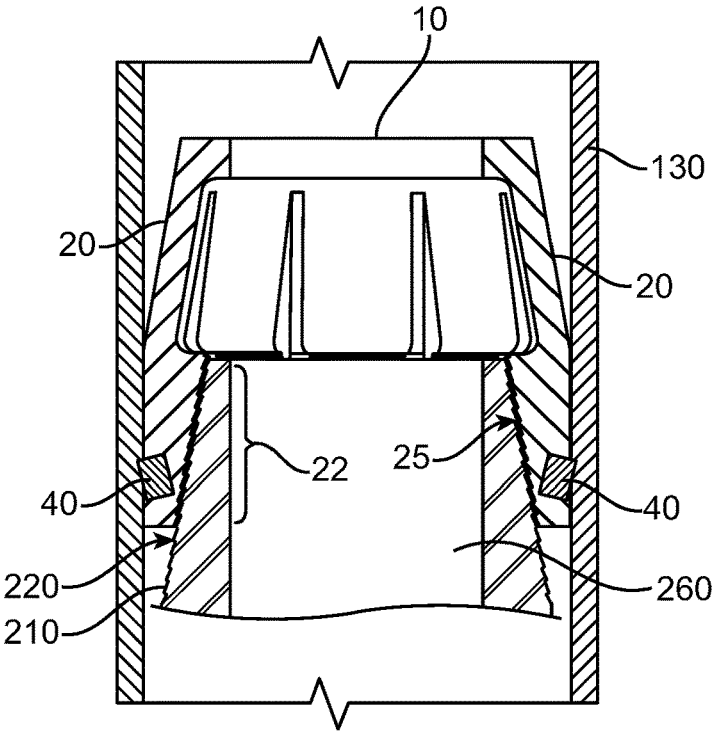
FIG. 9 is a cross-sectional diagram of the exemplary anchoring assembly of FIG. 8.

FIG. 8 shows the anchoring assembly 250 in an engaged configuration and partially surrounded by the casing 130 of the wellbore 120 (as shown in FIG. 1). To transition to the engaged configuration, the anchoring apparatus 100 is shifted in the direction of the downhole tool 200 such that the locking arm(s) 20 are shifted further over the surface of the first component 260 of the downhole tool 200. As the anchoring assembly 250 transitions to the engaged configuration, the sloped surface 22 of the locking arm(s) 20 of the anchoring apparatus 100 engages the sloped outer surface 220 of the first component 260 of the downhole tool 200 which acts to radially deform the locking arm(s) 20 of the anchoring apparatus 100. The protrusion(s) 210 on the sloped outer surface 220 of the first component 260 mate with the protrusion(s) 60 of the anchoring apparatus 100 such that the two devices are secured together. The protrusion(s) 60 and 210 can both be ramped shaped with the ramped surfaces of protrusion(s) 60 being arranged complementary to the ramped surfaces of protrusion(s) 210, thus permitting sliding over one another in one direction (when transitioning to the engaged configuration) while catching and locking against one another in the reverse direction, thereby preventing or inhibiting disengagement. A cross-sectional view of the engaged configuration is shown in FIG. 9, illustrating that when the first component 260 displaces the locking arm(s) 20 the griping protrusion(s) 40 on the outer surface of the locking arm(s) 20 can grip the casing 130 lining the wellbore 120, such that the downhole tool 200 and anchoring apparatus 100 are anchored into place.

Figure 10:
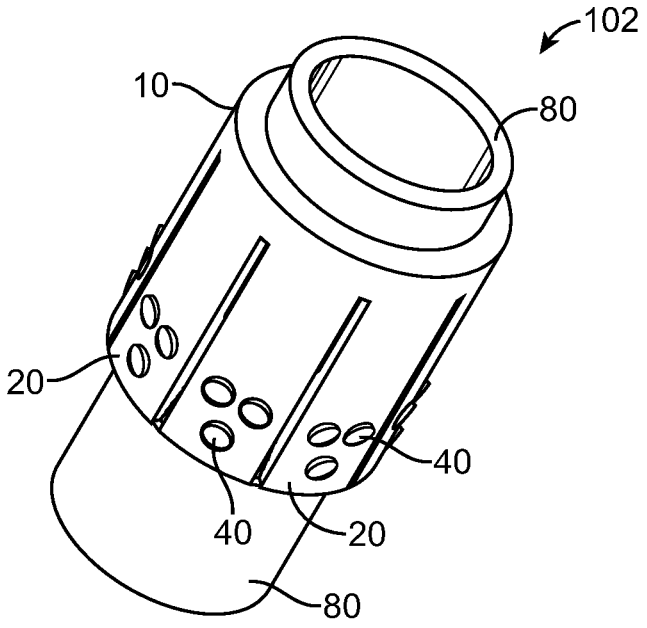
FIG. 10 is a diagram of a second exemplary embodiment of an anchoring apparatus according to the present disclosure.
Figure 11:
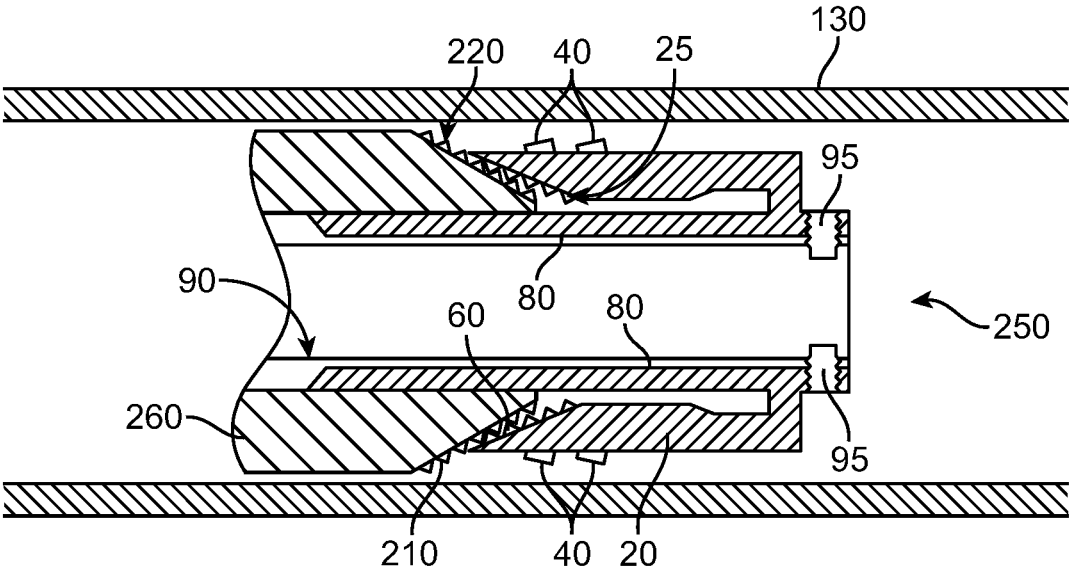
FIG. 11 is a cross-sectional diagram of the exemplary anchoring assembly of FIG. 10 in a resting configuration.

FIG. 10 depicts a second example of an anchoring apparatus 102, wherein the anchoring apparatus 102 includes a cylindrical inner mandrel 80 extending from the collar 10, which can be inserted into a flowbore of the downhole tool 200 to maintain alignment of the anchoring assembly 250 and the downhole tool 200. A cross-sectional view of the anchoring apparatus 102 is illustrated in FIG. 11 in a resting configuration within a wellbore. The inner mandrel 80 can be disposed within the first component 260 (shown in part), to stabilize and align the anchoring assembly prior to actuation of a setting device 90. A setting device 90 can be a device configured to fit within the inner mandrel 80 of the anchoring apparatus 102, and can be secured through a coupling means 95. The coupling means 95 can be, for example, shearing pins, or any other suitable coupling means.

The anchoring apparatus 100 and the downhole tool 200 can be run down the wellbore 120 together by releasably engaging the protrusion(s) 210 on the outer surface 220 of the first component 260 with the protrusion(s) 60 of the inner surface 25 of the anchoring apparatus 100, thus, setting the anchoring assembly 250 in the resting configuration. When anchoring apparatus 100 and the downhole tool 200 reach a desired location, the anchoring assembly 250 is actuated using a setting device 90. The setting device 90 can force the anchoring apparatus 100 and the downhole tool 200 together such that the inner surface 25 of the locking arm(s) 20 fully engages with the outer surface 220 of the downhole tool 200. The actuation of the setting device 90 radially deforms the locking arm(s) 20 away from the central axis of the anchoring apparatus 100, forcing the gripping protrusion(s) 40 on the outer surface of the locking arm(s) 20 to grip onto the casing 130 lining the wellbore 120.

The setting device 90 can be either a top-set tool, located at the upper portion of the anchoring assembly 250, or a bottom-set tool, located at the lower end of the anchoring assembly 250. A bottom-set tool can, for example, be coupled to the anchoring apparatus 100 extending uphole to become disposed within the first component 260 of the downhole tool 200 (as shown in FIG. 11). The setting device 90 can be coupled to the anchoring apparatus 100 using shearing pins, as shown in FIG. 11, or any other suitable coupling means. When the anchoring apparatus 100 and downhole tool 200 reach the desired location the setting device 90 is pulled back uphole, forcing the anchoring apparatus 100 to engage with the downhole tool 200. Alternatively, a top-set tool can, for example, be coupled to the uphole end of the downhole tool 200; such that the setting device 90 actuates by holding the downhole tool 200 in place while pulling the anchoring apparatus 100 uphole until the anchoring apparatus 100 engages with the downhole tool 200.

Figure 12:
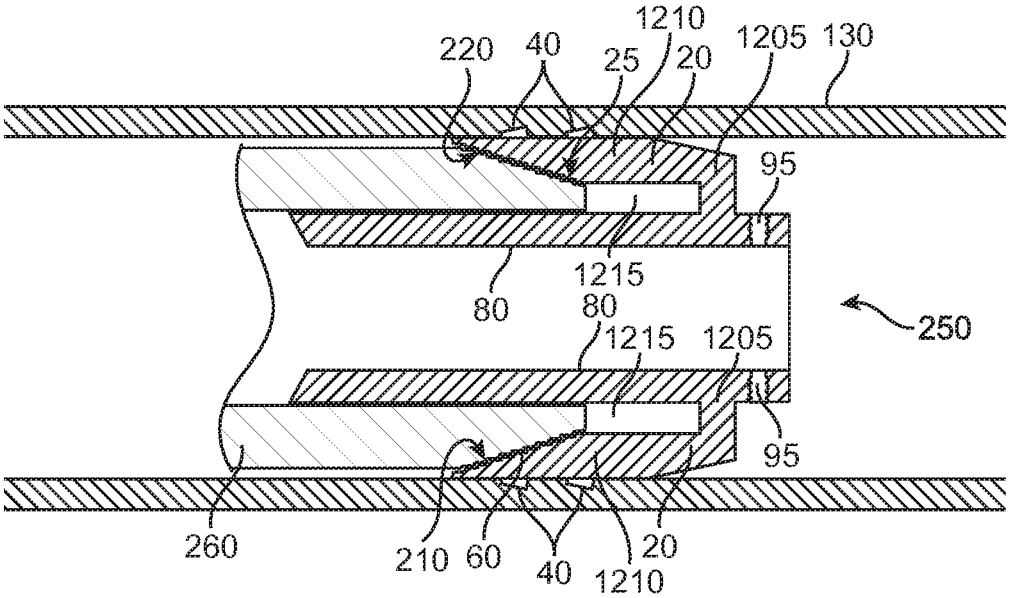
FIG. 12 is a cross-sectional diagram of the exemplary anchoring assembly of FIG. 10 in an engaged configuration.

FIG. 12 is a cross-sectional view illustrating the anchoring assembly 250 in an engaged configuration. As illustrated, each of the locking arms 20 have a first portion 1205 and a second portion 1210, with the first portion 1205 of each of the locking arms 20 extending from the collar 20 substantially perpendicular to the longitudinal axis, and the second portion 1210 of each of the locking arms extending substantially parallel to the longitudinal axis to form a gap 1215 between at least a portion of the second portion 1210 of each of the locking arms 20. As the setting device 90 is actuated, the anchoring apparatus 102 engages with the first component 260 of the downhole tool 200, such that the locking arm(s) 20 are radially displaced forcing the gripping protrusions 40 to bite into the casing 130 lining the wellbore 120. When the anchoring apparatus 102 is fully engaged with the downhole tool 200 and the anchoring assembly 250 is set, the coupling means 95 holding the setting device 90 in place releases, allowing the setting device 90 to be retracted to the surface, leaving the anchoring assembly 250 at the desired location within the wellbore 120.

Figure 13:
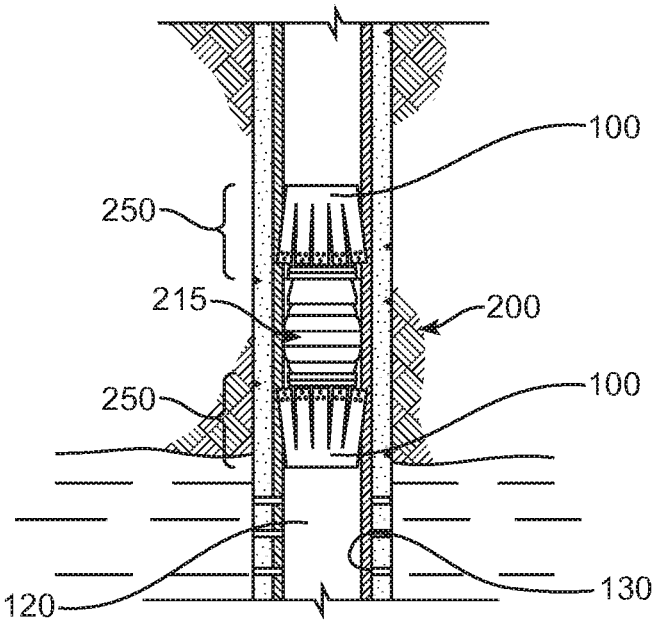
FIG. 13 is a diagram illustrating an exemplary environment for a third embodiment of an anchoring assembly in an engaged configuration.

Illustrated in FIG. 13 is a third example of an exemplary anchoring assembly 250 in an engaged configuration where the downhole device 200 is anchored on both the up-hole and down-hole ends by an anchoring apparatus 100.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The terms "comprising," "including" and "having" are used interchangeably in this disclosure. The terms "comprising," "including" and "having" mean to include, but not necessarily be limited to the things so described. The term "collar" refers to an enclosed band of material defining an aperture within the collar.

Numerous examples are provided herein to enhance understanding of the present disclosure. A specific set of statements are provided as follows.

Statement 1: A wellbore anchoring assembly including a downhole device having a first component and at least one first protrusion extending from an outer surface of the first component; a collar defining an inner space and having a longitudinal axis; and one or more deformable locking arms attached to the collar with at least a portion of each of the one or more locking arms extending in a direction substantially along the longitudinal axis of the collar, each of the one or more deformable locking arms being deformable away from the longitudinal axis, one or more gripping protrusions extending out from an outer surface of at least one of the deformable locking arms, and at least one second protrusion extending from an inner surface from at least one of the deformable locking arms; wherein the inner surface of at least one of the deformable locking arms is engageable with the sloped outer surface of the downhole device so as to deform the one or more deformable locking arms away from the longitudinal axis, and, upon said engagement, the at least one first protrusion engages the at least one second protrusion to secure the collar to the downhole device.

Statement 2: An apparatus is disclosed according to Statement 1, wherein the outer surface of the first component is sloped.

Statement 3: An apparatus is disclosed according to Statement 1 or Statement 2, wherein the inner surface is sloped toward the longitudinal axis from an end of the deformable locking arms.

Statement 4: An apparatus is disclosed according to Statements 1-3, wherein the one or more deformable locking arms are integrally formed with the collar.

Statement 5: An apparatus is disclosed according to Statements 1-3, wherein the collar has a main body portion with a first end and a second end and wherein the one or more deformable locking arms extend from the first end of the main body.

Statement 6: An apparatus is disclosed according to Statements 1-5, wherein each of the locking arms have a first portion and a second portion, with the first portion of each of the locking arms extending from the collar substantially perpendicular to the longitudinal axis, and a second portion of each of the locking arms extending substantially parallel to the longitudinal axis to form a gap between at least a portion of the second portion of each of the locking arms and the collar.

Statement 7: An apparatus is disclosed according to Statements 1-6, wherein the collar has a portion inserted within the downhole tool.

Statement 8: An apparatus is disclosed according to Statements 1-7, wherein the collar is cylindrical, octagonal, hexagonal, ovular, or ovoid.

Statement 9: An apparatus is disclosed according to Statements 1-8, wherein the downhole device is a frac plug or a packer.

Statement 10: An apparatus is disclosed according to Statements 1-9, wherein the downhole device further comprises an expandable seal.

Statement 11: An apparatus is disclosed according to Statements 1-10, wherein the engagement of the downhole device with the collar is actuated by a setting device; the setting device having a mandrel insertable into the first component of the downhole device and having one or more radially extending protrusions, and wherein upon actuation of the setting device the at least one first protrusion of the downhole device abuttingly urge the collar to engage the downhole device.

Statement 12: A downhole anchoring system including an anchoring assembly disposed within a wellbore, the anchoring assembly including a downhole device having a first component and at least one first protrusion extending from an outer surface of the first component; a collar defining an inner space and having a longitudinal axis; and one or more deformable locking arms attached to the collar with at least a portion of each of the one or more locking arms extending in a direction substantially along to the longitudinal axis of the collar, each of the one or more deformable locking arms being deformable away from the longitudinal axis, one or more gripping protrusions extending out from an outer surface of at least one of the deformable locking arms, and at least one second protrusion extending from an inner surface from at least one of the deformable locking arms; wherein the inner surface of at least one of the deformable locking arms is engageable with the outer surface of the downhole device so as to deform the one or more deformable locking arms away from the longitudinal axis, and upon said engagement the at least one first protrusion engages the at least one second protrusion to secure the collar to the downhole device; and a setting device.

Statement 13: A system is disclosed according to Statement 12, wherein the outer surface of the first component is sloped.

Statement 14: A system is disclosed according to Statement 12 or Statement 13, wherein the inner surface of at least one of the deformable locking arms is sloped toward the longitudinal axis from an end of the deformable locking arm.

Statement 15: A system is disclosed according to Statements 12-14, wherein the one or more deformable locking arms are integrally formed with the collar.

Statement 16: A system is disclosed according to Statements 12-14, wherein the collar has a main body portion with a first end and a second end and wherein the one or more deformable locking arms extend from the first end of the main body.

Statement 17: A system is disclosed according to Statements 12-16, wherein each of the locking arms has a first portion and a second portion, with the first portion of each of the locking arms extending from the collar substantially perpendicular to the longitudinal axis, and a second portion of each of the locking arms extending substantially parallel to the longitudinal axis to form a gap between at least a portion of the second portion of each of the locking arms and the collar.

Statement 18: A system is disclosed according to Statements 12-17, wherein the collar has a portion inserted within the downhole tool.

Statement 19: A system is disclosed according to Statements 12-18, wherein the collar is cylindrical, octagonal, hexagonal, ovular, or ovoid.

Statement 20: A system is disclosed according to Statements 12-19, wherein the downhole device is a frac plug or a packer.

Statement 21: A system is disclosed according to Statements 12-20, wherein the downhole device further comprises an expandable seal.

Statement 22: A system is disclosed according to Statements 12-21, wherein the engagement of the downhole device with the collar is actuated by a setting device; the setting device having a mandrel insertable into the first component of the downhole device and having one or more radially extending protrusions, and wherein upon actuation of the setting device the protrusion of the downhole device abuttingly urge the collar to engage the downhole area.

Statement 23: A system is disclosed according to Statements 12-22, wherein the setting device is positioned downhole from the anchoring assembly.

Statement 24: A system is disclosed according to Statements 12-23, wherein the setting device is positioned uphole from the anchoring assembly.

Statement 25: A method for anchoring a downhole device in a wellbore, the method including running a downhole device downhole within a wellbore, the downhole device having a first component and at least one first protrusion extending from the first component; and engaging an anchoring assembly with the downhole device, the anchoring assembly comprising: a collar defining an inner space and having a longitudinal axis; and one or more deformable locking arms attached to the collar with at least a portion of each of the one or more locking arms extending in a direction substantially along the longitudinal axis of the collar, each of the one or more deformable locking arms being deformable away from the longitudinal axis, one or more gripping protrusions extending out from an outer surface of at least one of the deformable locking arms, and at least one second protrusion extending from an inner surface from at least one of the deformable locking arms, and wherein upon engagement of the downhole device with the collar, the inner surface of at least one of the deformable locking arms engages with the downhole device so as to deform the one or more deformable locking arms away from the longitudinal axis, and upon said engagement the at least one first protrusion engages the at least one second protrusion to secure the collar to the first component.

Statement 26: A method is disclosed according to Statement 25, wherein the outer surface of the first component is sloped.

Statement 27: A method is disclosed according to Statement 25 or Statement 26, wherein the inner surface of at least one of the deformable locking arms is sloped toward the longitudinal axis from an end of the deformable locking arm.

Statement 28: A method is disclosed according to Statements 25-27, wherein the one or more deformable locking arms are integrally formed with the collar.

Statement 29: A method is disclosed according to Statements 25-27, wherein the collar has a main body portion with a first end and a second end and wherein the one or more deformable locking arms extend from the first end of the main body.

Statement 30: A method is disclosed according to Statements 25-29, wherein each of the locking arms has a first portion and a second portion, with the first portion of each of the locking arms extending from the collar substantially perpendicular to the longitudinal axis, and a second portion of each of the locking arms extending substantially parallel to the longitudinal axis to form a gap between at least a portion of the second portion of each of the locking arms and the collar.

Statement 31: A method is disclosed according to Statements 25-30, wherein the collar has a portion inserted within the downhole tool.

Statement 32: A method is disclosed according to Statements 25-32, wherein the collar is cylindrical, octagonal, hexagonal, ovular, or ovoid.

Statement 33: A method is disclosed according to Statements 25-23, wherein the downhole device is a frac plug or a packer.

Statement 34: A method is disclosed according to Statements 25-33, wherein the downhole device further comprises an expandable seal.

Statement 35: A method is disclosed according to Statements 25-34, wherein the engagement of the downhole device with the collar is actuated by a setting device; the setting device having a mandrel insertable into the first component of the downhole device and having one or more radially extending protrusions, and wherein upon actuation of the setting device the protrusion of the downhole device abuttingly urge the collar to engage the downhole device.

Statement 36: A method is disclosed according to Statements 25-35, wherein the setting device is positioned downhole from the anchoring assembly.

Statement 37: A method is disclosed according to Statements 25-36, wherein the setting device is positioned uphole from the anchoring assembly.

Statement 38: A wellbore anchoring assembly including a first component with a sloped outer surface having at least one protrusion; a second component with a mating sloped inner surface to said first component with at least one deformable arm and having at least one protrusions on the sloped inner surface; the deformable arms are deformable away from the longitudinal axis, with one or more gripping protrusions extending out from an outer surface of at least one of the deformable locking arms; wherein the inner surface of at least one of the deformable arms is engageable with the sloped outer surface of the first component so as to deform the deformable arms away from the longitudinal axis, and upon said engagement the at least one first protrusion engages the at least one second protrusion to secure the secure the second component to the first component.

Statement 39: An apparatus usable in a wellbore, the apparatus including a first component of a downhole device that anchors the device to the casing, wherein the first component locks into a second component, the first and second component forming a joined assembly, wherein the joined assembly prevents axial movement of the first component, firmly anchoring the device into the casing.

Statement 40: A method is disclosed according to Statement 39, wherein the first component has a geometry that mates to the second component.

Statement 41: A method is disclosed according to Statements 39 or Statement 40, wherein the second component has a geometry that mates to the first component.

Statement 42: A method is disclosed according to Statements 39-41, wherein the first component and the second component comprising parallel surfaces in which the mating occurs.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore anchoring assembly comprising:

a downhole device having a first component and at least one first protrusion extending from an outer surface of the first component;

a collar defining an inner space and having a longitudinal axis; and one or more deformable locking arms attached to the collar with at least a portion of each of the one or more locking arms extending in a direction substantially along the longitudinal axis of the collar, the one or more deformable locking arms being integrally formed with the collar, each of the one or more deformable locking arms being deformable away from the longitudinal axis, one or more gripping protrusions extending out from an outer surface of at least one of the deformable locking arms, and at least one second protrusion extending from an inner surface from at least one of the deformable locking arms;

wherein the inner surface of at least one of the deformable locking arms is engageable with a sloped outer surface of the downhole device so as to deform the one or more deformable locking arms away from the longitudinal axis, and, upon said engagement the deformable locking arms are transitioned to an engaged configuration, wherein the at least one first protrusion engages the at least one second protrusion to secure the collar to the downhole device, and the collar maintaining a unitary integral piece subsequent deformation of the deformable locking arms and after transitioning to the engaged configuration.

2. The anchoring assembly of claim 1, wherein the inner surface is sloped toward the longitudinal axis from an end of the deformable locking arms.

3. The anchoring assembly of claim 1, wherein the collar has a main body portion with a first end and a second end and wherein the one or more deformable locking arms extend from the first end of the main body.

4. The anchoring assembly of claim 1, wherein each of the locking arms have a first portion and a second portion, with the first portion of each of the locking arms extending from the collar substantially perpendicular to the longitudinal axis, and a second portion of each of the locking arms extending substantially parallel to the longitudinal axis to form a gap between at least a portion of the second portion of each of the locking arms and the collar.

5. The anchoring assembly of claim 1, wherein the collar has a portion inserted within the downhole device.

6. The anchoring assembly of claim 1, wherein the downhole device is a frac plug or a packer.

7. The anchoring assembly of claim 1, wherein the downhole device further comprises an expandable seal.

8. The anchoring assembly of claim 1, wherein the engagement of the downhole device with the collar is actuated by a setting device;

the setting device having a mandrel insertable into the first component of the downhole device and having one or more radially extending protrusions, and wherein upon actuation of the setting device, the at least one first protrusion of the downhole device abuttingly urge the collar to engage the downhole device.

9. A downhole anchoring system comprising:

an anchoring assembly disposed within a wellbore, the anchoring assembly comprising:

a downhole device having a first component and at least one first protrusion extending from an outer surface of the first component;

a collar defining an inner space and having a longitudinal axis; and one or more deformable locking arms attached to the collar with at least a portion of each of the one or more locking arms extending in a direction substantially along the longitudinal axis of the collar, the one or more deformable locking arms are integrally formed with the collar, each of the one or more deformable locking arms being deformable away from the longitudinal axis, one or more gripping protrusions extending out from an outer surface of at least one of the deformable locking arms, and at least one second protrusion extending from an inner surface from at least one of the deformable locking arms;

wherein the inner surface of at least one of the deformable locking arms is engageable with the outer surface of the downhole device so as to deform the one or more deformable locking arms away from the longitudinal axis, and upon said engagement the deformable locking arms are transitioned to an engaged configuration, wherein the at least one first protrusion engages the at least one second protrusion to secure the collar to the downhole device, and the collar maintaining a unitary integral piece subsequent deformation of the deformable locking arms and after transitioning to the engaged configuration; and a setting device.

10. The system of claim 9, wherein the inner surface of at least one of the deformable locking arms is sloped toward the longitudinal axis from an end of the deformable locking arm.

11. The system of claim 9, wherein the collar has a main body portion with a first end and a second end and wherein the one or more deformable locking arms extend from the first end of the main body.

12. The system of claim 9, wherein each of the locking arms has a first portion and a second portion, with the first portion of each of the locking arms extending from the collar substantially perpendicular to the longitudinal axis, and a second portion of each of the locking arms extending substantially parallel to the longitudinal axis to form a gap between at least a portion of the second portion of each of the locking arms and the collar.

13. The system of claim 9, wherein the collar has a portion inserted within the downhole device.

14. The system of claim 9, wherein the downhole device is a frac plug or a packer.

15. The system of claim 9, wherein the downhole device further comprises an expandable seal.

16. The system of claim 9, wherein the engagement of the downhole device with the collar is actuated by a setting device;

a setting device having a mandrel insertable into the first component of the downhole device and having one or more radially extending protrusions, and wherein upon actuation of the setting device the protrusion of the downhole device abuttingly urge the collar to engage the downhole area.

17. The system of claim 9, wherein the setting device is positioned down-hole from the anchoring assembly.

18. The system of claim 9, wherein the setting device is positioned up-hole from the anchoring assembly.

* * * * *